US012674580B2

(12) United States Patent
Naik et al.

(10) Patent No.: US 12,674,580 B2
(45) Date of Patent: Jul. 7, 2026

(54) COMBUSTION LINER

(71) Applicant: General Electric Company, Evendale, OH (US)

(72) Inventors: Pradeep Naik, Bengaluru (IN); Shai Birmaher, Cincinnati, OH (US); Saket Singh, Bengaluru (IN); Krishnendu Chakraborty, Bengaluru (IN)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

(21) Appl. No.: 18/990,975

(22) Filed: Dec. 20, 2024

(65) Prior Publication Data

US 2025/0129940 A1 Apr. 24, 2025

Related U.S. Application Data

(62) Division of application No. 17/663,093, filed on May 12, 2022, now Pat. No. 12,173,900.

(30) Foreign Application Priority Data

Nov. 11, 2021 (IN) ..... 202111051692

(51) Int. Cl.
*F23R 3/00* (2006.01)
*F23R 3/06* (2006.01)
*F23R 3/16* (2006.01)

(52) U.S. Cl.
CPC ..... *F23R 3/06* (2013.01); *F23R 3/16* (2013.01); *F23R 2900/03045* (2013.01)

(58) Field of Classification Search
None
See application file for complete search history.

(56) References Cited

U.S. PATENT DOCUMENTS 3,952,503 A 4/1976 Fox et al.
3,990,231 A 11/1976 Irwin
3,990,837 A 11/1976 Snell
4,773,227 A 9/1988 Chabis
(Continued)

FOREIGN PATENT DOCUMENTS

CN 102155297 A 8/2011
GB 2512642 A 10/2014

OTHER PUBLICATIONS

Naik et al., U.S. Appl. No. 17/340,585, filed Jun. 7, 2021.
(Continued)

*Primary Examiner* — Edwin Kang
(74) *Attorney, Agent, or Firm* — Venable LLP; Duarte Y Ho; Michele V. Frank

(57) ABSTRACT

A liner for a combustor in a gas turbine engine and a related method. The liner includes a liner body having a cold side and a hot side. The liner includes a dilution passage having a concatenated geometry extending through the liner body. The dilution passage is configured (i) to integrate a first dilution air flow flowing through the dilution passage from the cold side to the hot side and a second dilution air flow flowing through the dilution passage from the cold side to the hot side into an integrated dilution air flow, and (ii) to inject the integrated dilution air flow into a core primary combustion zone of the combustor to attain a predetermined combustion state of the combustor.

20 Claims, 9 Drawing Sheets

(56) References Cited

U.S. PATENT DOCUMENTS

| | | | | |
|---|---|---|---|---|
| 6,070,412 | A | 6/2000 | Ansart et al. | |
| 7,654,089 | B2 | 2/2010 | Schilling et al. | |
| 9,010,123 | B2 | 4/2015 | Rudrapatna et al. | |
| 9,038,395 | B2 | 5/2015 | Rudrapatna et al. | |
| 9,328,665 | B2 | 5/2016 | Doerr et al. | |
| 9,416,971 | B2 | 8/2016 | Xu | |
| 10,301,964 | B2 | 5/2019 | Spangler et al. | |
| 10,330,319 | B2 | 6/2019 | Duesing et al. | |
| 10,378,774 | B2 | 8/2019 | Hu et al. | |
| 10,386,070 | B2 | 8/2019 | Sandoval et al. | |
| 10,533,746 | B2 | 1/2020 | Rimmer et al. | |
| 10,684,017 | B2 | 6/2020 | Moura et al. | |
| 11,686,473 | B2 | 6/2023 | Naik et al. | |
| 2002/0189260 | A1 | 12/2002 | Etienne et al. | |
| 2003/0213250 | A1* | 11/2003 | Pacheco-Tougas | F23R 3/06 60/752 |
| 2005/0081526 | A1 | 4/2005 | Howell et al. | |
| 2015/0260403 | A1* | 9/2015 | Clemen | F23R 3/06 60/752 |
| 2016/0298843 | A1 | 10/2016 | Cunha et al. | |
| 2016/0327272 | A1 | 11/2016 | Sandoval et al. | |
| 2017/0370584 | A1* | 12/2017 | Boardman | F23R 3/286 |

OTHER PUBLICATIONS

Sampath et al., U.S. Appl. No. 17/340,856, filed Jun. 7, 2021.
Ganiger et al., U.S. Appl. No. 17/340,703, filed Jun. 7, 2021.
Ganiger et al., U.S. Appl. No. 17/340,764, filed Jun. 7, 2021.
Ganiger et al., U.S. Appl. No. 17/340,816, filed Jun. 7, 2021.
Naik et al., U.S. Appl. No. 17/663,095, filed May 12, 2022.
Naik et al., U.S. Appl. No. 17/663,098, filed May 12, 2022.
Naik et al., U.S. Appl. No. 17/663,103, filed May 12, 2022.

* cited by examiner

COMBUSTION LINER

CROSS REFERENCE TO RELATED APPLICATIONS

This application is a divisional of U.S. patent application Ser. No. 17/663,093 filed on May 12, 2022, which claims the benefit of Indian Patent Application No. 202111051692, filed on Nov. 11, 2021, the contents of both of which are hereby incorporated by reference in their entireties.

TECHNICAL FIELD

The present disclosure relates to a combustion liner. In particular, the present disclosure relates to a liner for a combustor in a gas turbine engine, the liner having dilution openings and passages around the dilution openings.

BACKGROUND

A gas turbine engine includes a combustion section having a combustor that generates combustion gases that are discharged into the turbine section of the engine. The combustion section includes a combustion liner. Current combustion liners include dilution openings in the liner. The dilution openings provide dilution air flow to the combustor. The dilution air flow mixes with primary zone products within the combustor.

BRIEF DESCRIPTION OF THE DRAWINGS

Features and advantages will be apparent from the following, description of various exemplary embodiments, as illustrated in the accompanying drawings, wherein like reference numbers generally indicate identical, functionally similar, and/or structurally similar elements.

DETAILED DESCRIPTION

Figure 1:
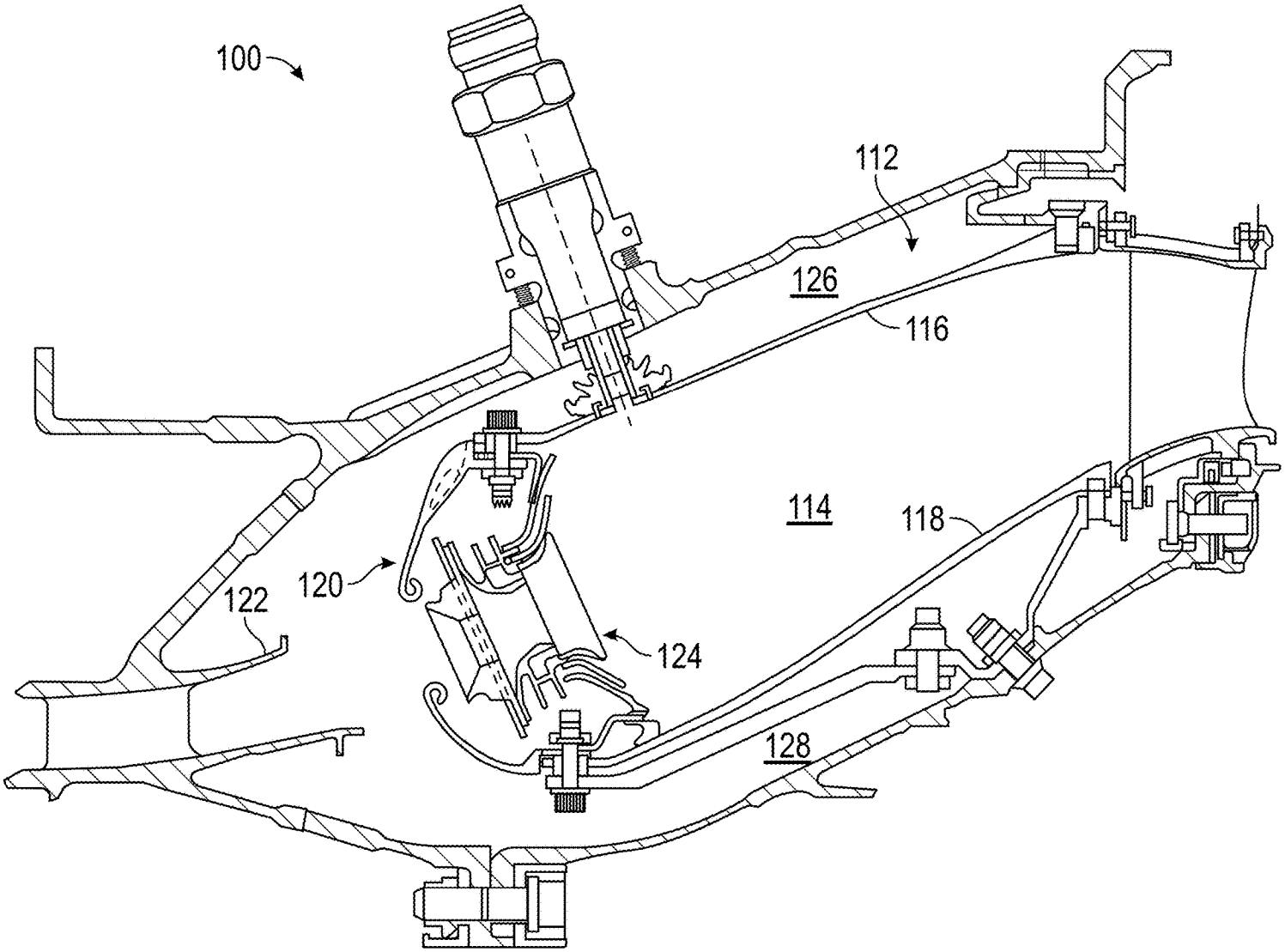
FIG. 1 shows a schematic, cross-sectional view of a combustion section of a gas turbine engine, according to an embodiment of the present disclosure.

Various embodiments are discussed in detail below. While specific embodiments are discussed, this is done for illustration purposes only. A person skilled in the relevant art will recognize that other components and configurations may be used without departing from the spirit and scope of the present disclosure.

Reference will now be made in detail to present embodiments of the disclosed subject matter, one or more examples of which are illustrated in the accompanying drawings. The detailed description uses numerical and letter designations to refer to features in the drawings. Like or similar designations in the drawings and description have been used to refer to like or similar parts of the disclosed subject matter. As used herein, the terms "first," "second," "third", "fourth," and "exemplary" may be used interchangeably to distinguish one component from another and are not intended to signify location or importance of the individual components.

The terms "upstream" or "forward" and "downstream" or "aft" refer to the relative direction with respect to fluid flow in a fluid pathway. For example, "upstream" refers to the direction from which the fluid flows, and "downstream" refers to the direction to which the fluid flows. For example, "forward" refers to a front end or direction of the engine and "aft" refers to a rear end or direction of the engine.

Gas turbine engines, such as those used to power aircrafts or industrial applications, include a compressor, a combustor, and a turbine, disposed about a central engine axis, with the compressor disposed axially upstream of the combustor and the turbine disposed axially downstream of the combustor. The compressor pressurizes a supply of air, the combustor burns a hydrocarbon fuel in the presence of the pressurized air, and the turbine extracts energy from the resultant combustion gases. Air pressure ratio and/or exit temperature of a combustor can be changed to improve gas turbine engine-cycle efficiencies. Further, any change in the air pressure ratio and/or exit temperature of a combustor can impact the operability and the life of the turbine. Combustor exit temperatures above 1100° C. are now common in gas turbine engines while acceptable metal temperatures for the stationary nozzles and rotating blades of a turbine are still limited to 900° C. or 1000° C. Further, the temperature of a turbine blade impacts the mechanical strength of the blade (e.g., creep and fatigue) as well as the oxidation and corrosion resistance of the blade. Maintaining the combustor temperature within an acceptable range can improve the life of the turbine blades and the turbine nozzles considerably.

Structurally, combustor liners are provided inside combustors to withstand the extreme thermal loads and extensive combustor liner cooling arrangements are likely to reduce thermal stress in several mechanical parts and components of a gas turbine engine.

In a combustor of a gas turbine engine, air generally flows through an outer passage and an inner passage surrounding a combustor liner. The air flows from an upstream end of the combustor liner to a downstream end of the combustor liner. Some of the air flowing through the outer passage and the inner passage is diverted through a number of dilution holes provided in the combustor liner and into a core primary combustion zone as dilution air. One purpose of the dilution air flow is to cool (i.e., quench) the combustion gases within the core primary combustion zone before the gases enter a turbine section. Quenching of the products of combustion from a core primary combustion zone of a combustor must, however, be done quickly and efficiently so that regions of high temperature are minimized, and, thereby, $NO_x$ emissions from the combustion system are reduced.

Utilizing discrete dilution holes (also referred to as "discrete holes") and annular dilution slots (also referred to as "annular slots") through a liner that essentially form flow passages through the liner is known. In a discrete dilution situation, high turbulence is introduced into the core primary combustion zone of a combustor from a number of discrete jets. As a result, good mixing of the combustion products is achieved after dilution. There remains, however, pockets of high temperature regions within the combustor core due to low jet penetration. Further, wake regions formed behind discrete dilution jets and between discrete dilution jets give rise to low cooling and low mixing of the dilution air with the primary combustion products. In annular dilution, on the other hand, jet penetration level is high, but turbulence generated is low resulting in low level mixing of the dilution air with primary zone products post dilution flow entry giving rise to potential higher temperature in the core of the combustor post dilution thereby creating higher exit temperature profile/pattern and can have a negative impact on combustion efficiency.

The present disclosure provides a way to synergistically combine the advantages of discrete dilution and annular dilution by providing a combustor includes a liner body having a cold side and a hot side. The liner body includes a dilution passage having a concatenated geometry extending through the liner body. A first dilution air flow and a second dilution air flow pass through the dilution passage from the cold side of the combustion liner to the hot side of the combustor liner. The dilution passage integrates the first dilution air flow and the second dilution air flow within the concatenated geometry into an integrated dilution air flow and injects the integrated dilution air flow into a core primary combustion zone of a combustor to attain a predetermined combustion state of the combustor.

FIG. 1 shows a schematic, cross-sectional view of a combustion section 100 of a gas turbine engine, according to an embodiment of the present disclosure. The combustion section 100 includes a combustor 112 that generates combustion gases that are discharged into the turbine section (not shown) of the engine. The combustor 112 includes a core primary combustion zone 114. The core primary combustion zone 114 is bound by an outer liner 116, an inner liner 118, and a cowl 120. Additionally, a diffuser 122 is positioned upstream of the core primary combustion zone 114. The diffuser 122 receives an airflow from the compressor section (not shown) of the engine and provides the flow of compressed air to the combustor 112. The diffuser 122 provides the flow of compressed air to cowl 120 of a swirler 124. Air flows through an outer passage 126 and an inner passage 128.

Figure 2:
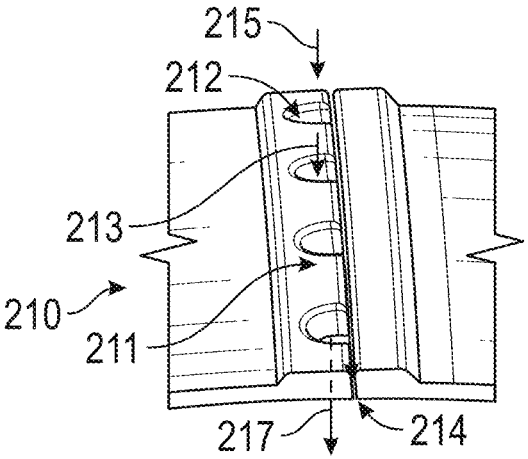
FIG. 2 shows schematic, side perspective view of a dilution passage through a combustion liner for a combustor, according to an embodiment of the present disclosure.
Figure 3:
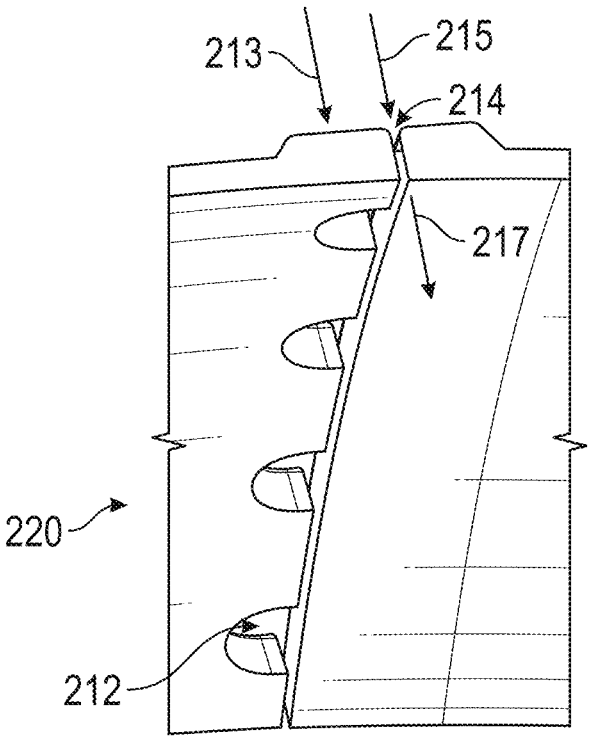
FIG. 3 shows a schematic side view of the dilution passage of the liner of FIG. 2, according to an embodiment of the present disclosure.

FIGS. 2 and 3 are schematic representations of a liner for a combustor, according to an embodiment of the present disclosure. Referring to FIG. 2, a side perspective view 210 schematically represents a dilution passage 211 extending through a combustion liner for a combustor. Referring to FIG. 3, reference numeral 220 indicates a bottom view that shows the dilution passage 211 of FIG. 2. The dilution passage 211 has a geometry that is formed by concatenating (or physically joining two adjacent entities end to end, blending them into one entity) an exemplary first geometry and an exemplary second geometry. Referring to FIGS. 2 and 3, the first geometry, embodied as a number of discrete holes 212, and the second geometry, embodied as an annular slot 214 extending through the combustor liner, are concatenated into the dilution passage 211.

The discrete holes 212 and the annular slot 214 are concatenated at a predetermined relative position. Referring to FIGS. 2 and 3, the discrete holes 212 are positioned forward or upstream and the annular slot 214 positioned aft or downstream. The discrete holes 212 have a semi-circular cross section. Although not shown, a bridge structure may connect the discrete holes 212 to the annular slot 214 to allow for control of a dilution gap between the annular slot 214 and the discrete holes 212. The bridge structure may be connected to the aft face of the liner forming the annular slot 214 (e.g., aft face 359 of FIG. 6). In some examples, the bridge structure may be welded to the annular slot 214. The bridge structure may support and control the dilution gap.

A first dilution air flow 213, passing through the discrete holes 212, is integrated with the second dilution air flow 215 passing through the annular slot 214 into an integrated dilution air flow 217, within the concatenated geometry of the dilution passage 211. Further, the integrated dilution air flow 217 is injected into the core primary combustion zone 114 of the combustor 112 of FIG. 1 to attain a predetermined combustion state of the combustor 112.

The integrated dilution air flow 217 improves a number of desired combustion states of the combustor. The second dilution air flow 215 provides a hydraulic support for the first dilution air flow 213, improving jet penetration in the process. The integrated dilution air flow 217 reduces temperature in the core primary combustion zone 114 of the combustor 112 of FIG. 1 and an emission level of nitrogen oxides ($NO_x$) is rendered compliant with regulatory guidelines. Further, an air split ratio or a distribution or share of the first dilution air flow 213 and the second dilution air flow 215 in the integrated dilution air flow 217 is adjusted to reduce the temperature in the core primary combustion zone 114. Furthermore, the portion of the second dilution air flow 215 of the integrated dilution air remains closer to the liner around the circumference of the liner and maintains lower liner temperature behind the integrated dilution structure.

The integrated dilution air flow 217 aids in rapid quenching and a quick mixing of the first dilution air flow 213 and the second dilution air flow 215 with a number of combustion products in the core primary combustion zone 114 of the combustor 112. The increased mixing leads to a uniform temperature distribution within the core primary combustion zone 114 of the combustor 112, and, further, to a combustor liner temperature that conforms with a reference combustor liner temperature.

Figure 4:
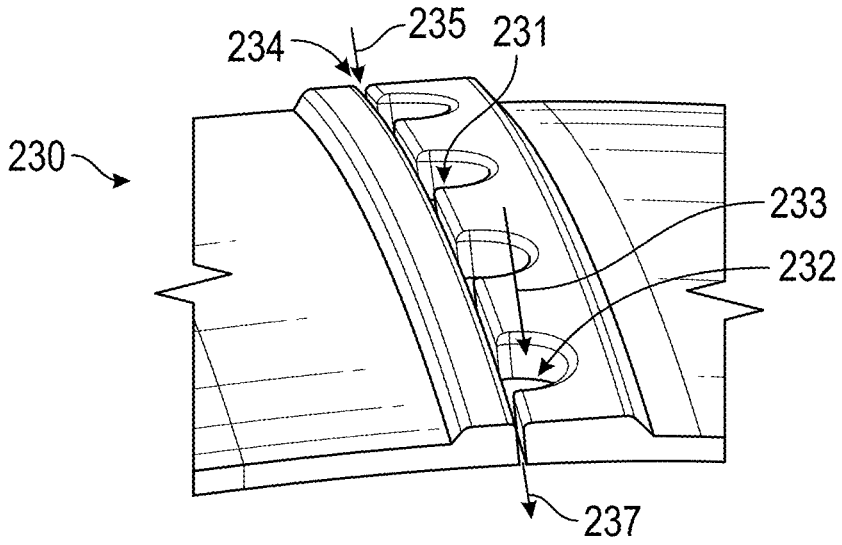
FIG. 4 shows a schematic, side perspective view of a mirrored version of the combustion liner of FIG. 2, according to an embodiment of the present disclosure.

FIG. 4 shows a schematic representation of a mirrored version of the dilution passage 211 of FIG. 2, according to an embodiment of the present disclosure. Referring to FIG.

4, reference numeral 230 indicates a top perspective view that shows a schematic representation of a dilution passage 231 through a combustion liner of a combustor. The dilution passage 231 concatenates a series of discrete holes 232 with an annular slot 234, forward (upstream) from the discrete holes 232. A first dilution air flow 233 passing through discrete holes 232 is integrated with a second dilution air flow 235 passing through the annular slot 234 into an integrated dilution air flow 237, within the concatenated geometry of the dilution passage 231. Further, the integrated dilution air flow is injected into the core primary combustion zone 114 of the combustor 112 of FIG. 1 to attain a predetermined combustion state of the combustor 112.

Figure 5:
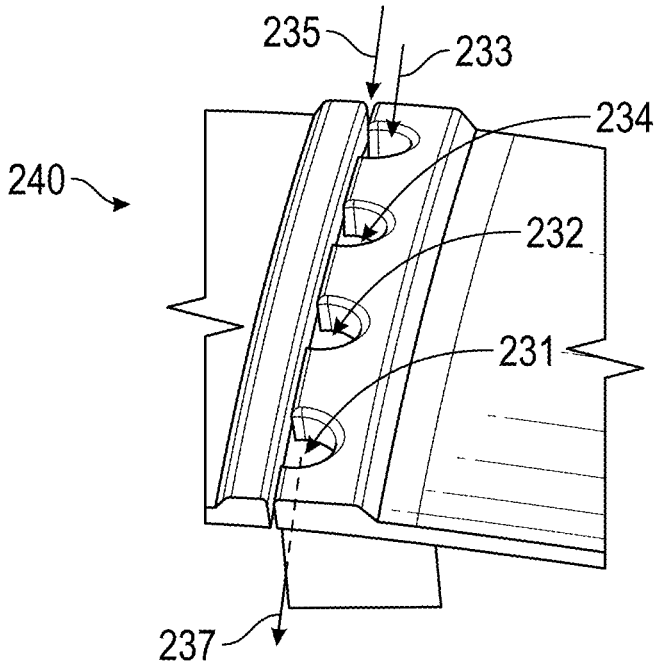
FIG. 5 shows a schematic, side perspective view of the dilution passage of the liner of FIG. 4, according to an embodiment of the present disclosure.

Referring to FIG. 5, reference numeral 240 indicates a side perspective view of the dilution passage 231 of FIG. 4. The first dilution air flow 233 passes through discrete holes 232 and the second dilution air flow 235 passes through the annular slot 234. The second dilution air flow 235 provides a hydraulic shielding for the first dilution air flow 233, improving jet penetration in the process.

Referring to FIGS. 1 to 5, a velocity distribution of combustion products within the core primary combustion zone 114 (FIG. 1) of the combustor 112 (FIG. 1) is improved by integrating the first dilution air flow (213, 233) and the second dilution air flow (215, 235) into the integrated dilution air flow (217, 237), within the dilution passage (211, 231). Specifically, low velocity of combustion products, generally associated with a dilution configuration having only discrete dilution holes, is enhanced by the integration of the first dilution air flow and the second dilution air flow into the integrated dilution air flow within the dilution passage. Further, high penetration of dilution air, generally associated with a dilution configuration having only annular dilution passages, is further enhanced by the integration of the first dilution air flow and the second dilution air flow into the integrated dilution air flow within the dilution passage.

Further, a temperature distribution of combustion products within the core primary combustion zone 114 (FIG. 1) of the combustor 112 (FIG. 1) is improved by integrating the first dilution air flow (213, 233) and the second dilution air flow (215, 235) into the integrated dilution air flow (217, 237), within the dilution passage (211, 231). Specifically, localization of high temperature near an outer periphery of the core primary combustion zone 114 (FIG. 1), generally associated with a dilution configuration having only discrete dilution holes, is reduced by the integration of the first dilution air flow and the second dilution air flow into the integrated dilution air flow within the dilution passage. Further, localization of high temperature near a central portion of the core primary combustion zone 114 (FIG. 1), generally associated with a dilution configuration having only annular dilution passages, is reduced by the integration of the first dilution air flow and the second dilution air flow into the integrated dilution air flow within the dilution passage.

Further, the $NO_x$ emission status within a core primary combustion zone 114 (FIG. 1) in the combustor 112 (FIG. 1) is improved by the integrating the first dilution air flow (213, 233) and the second dilution air flow (215, 235) into the integrated dilution air flow (217, 237), within the dilution passage (211, 231). Specifically, high $NO_x$ emission near an outer periphery of the core primary combustion zone 114 (FIG. 1), generally associated with a dilution configuration having only discrete dilution holes, is reduced by the integration of the first dilution air flow and the second dilution air flow into the integrated dilution air flow within the dilution passage. Further, high $NO_x$ emission near a central portion of the core primary combustion zone 114 of FIG. 1, generally associated with a dilution configuration having only annular dilution passages, is reduced by the integration of the first dilution air flow and the second dilution air flow into the integrated dilution air flow within the dilution passage.

Figure 6:
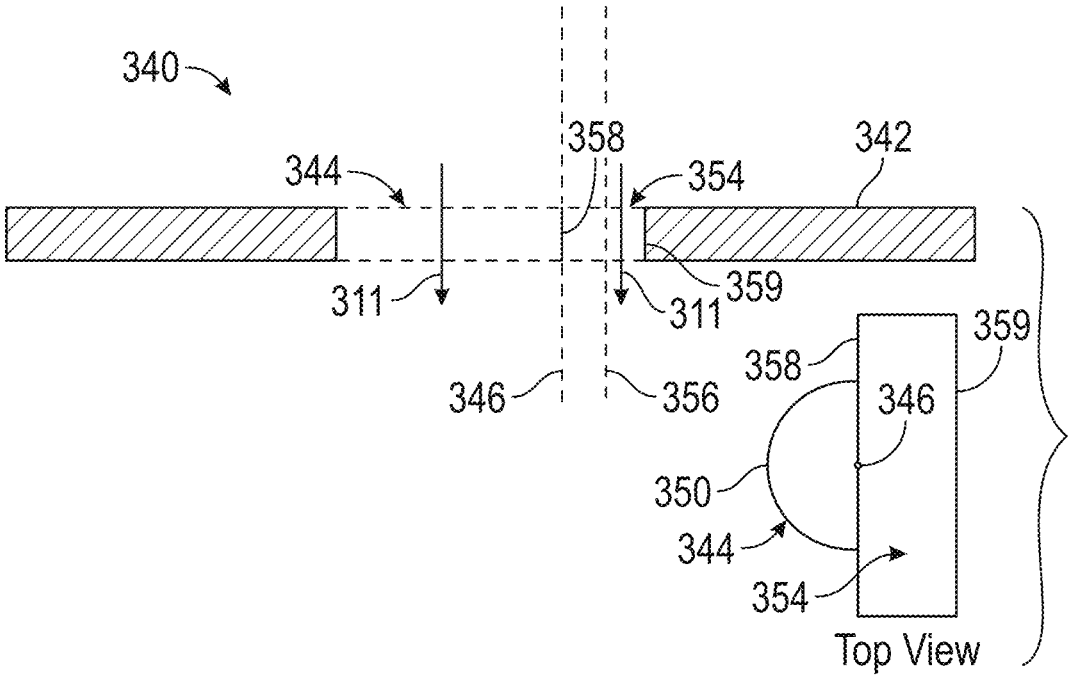
FIG. 6 shows a schematic side cross-sectional view of a dilution passage of a combustion liner, according to an embodiment of the present disclosure.

FIG. 6 shows a schematic side cross-sectional view of a dilution passage 311 of a combustion liner 342. The combustion liner 342 may be the same as or similar to the combustion liner of FIG. 2. Referring to FIG. 6, a side view 340 schematically represents the dilution passage 311, which may be similar to the dilution passage 211 of FIG. 2. The dilution passage 311 extends through the combustion liner 342 of a combustor. The combustion liner 342 may be an inner liner or an outer liner of the combustion chamber. The dilution passage 311 has a geometry that is formed by concatenating a series of discrete dilution holes 344 and an annular dilution slot 354. Each discrete dilution hole 344 may be semicircular in cross section. For example, in a top view of the discrete dilution hole 344, a geometry 350 of the discrete dilution hole 344 may be semicircular. A centerline of the circle formed by two halves of the semi-circle may be a centerline 346 of each of the discrete dilution hole 344. That is, an axis extending through the center of the diameter of the discrete dilution hole 344 aligns with the centerline 346. The annular dilution slot 354 may have a forward face 358 and an aft face 359.

With continued reference to FIG. 6, the centerlines 346 of the discrete dilution holes 344 are parallel to a centerline 356 of the annular dilution slot 354. The forward face 358 of the annular dilution slot 354 merges and aligns with each of the diameters of the discrete dilution holes 344, which may have a semicircular geometry. Thus, the centerlines 346 of the discrete dilution holes 344 are in line with the forward face 358 of the annular dilution slot 354 at the axial location of the forward face 358 of the annular dilution slot 354, such as shown in the top view. Further, ten percent to ninety percent of a total flow area of the dilution passage 311 is occupied by the discrete dilution holes 344 and the rest of the total flow area is occupied by the annular dilution slot 354.

Figure 7:
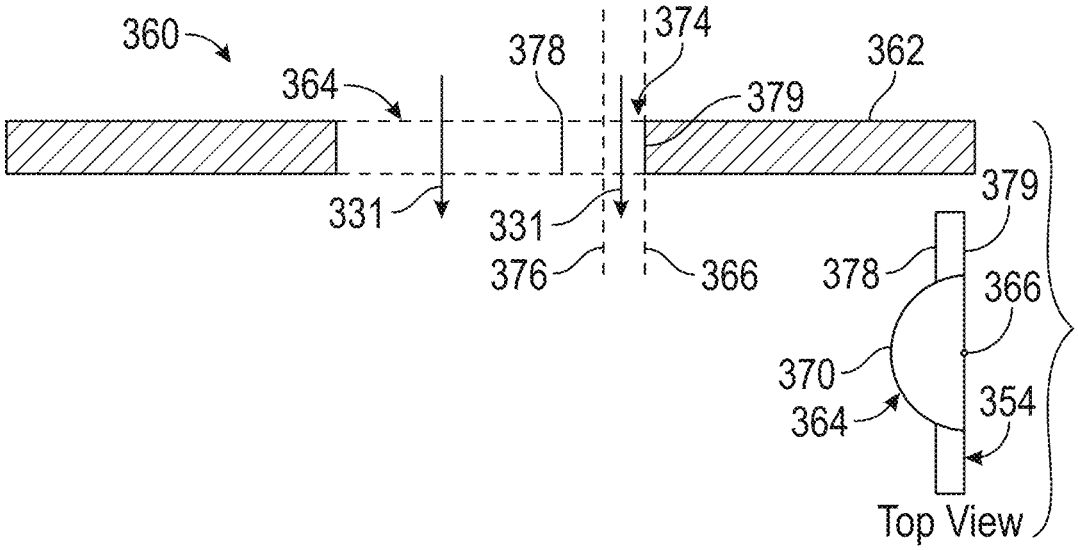
FIG. 7 shows a schematic side cross-sectional view of a dilution passage of a combustion liner, according to an embodiment of the present disclosure.

FIG. 7 shows a schematic side view cross-sectional of a dilution passage 331 of a combustion liner 362. The combustion liner 362 may be the same as or similar to the combustion liner of FIG. 2. Referring to FIG. 7, a side view 360 schematically represents the dilution passage 331, which may be similar to the dilution passage 211 of FIG. 2. The dilution passage 331 extends through the combustion liner 362 of a combustor. The dilution passage 311 has a geometry that is formed by concatenating a series of discrete dilution holes 364 and an annular dilution slot 374. Each discrete dilution hole 364 may be semicircular in cross section. For example, in a top view of the discrete dilution hole 364, a geometry 370 of the discrete dilution hole 364 may be semicircular. A centerline of the circle formed by two halves of the semi-circle may be a centerline 366 of each of the discrete dilution hole 364. That is, an axis extending through the center of the diameter of the discrete dilution hole 364 aligns with the centerline 366. The annular dilution slot 374 may have a forward face 378 and an aft face 379.

With continued reference to FIG. 7, the centerlines 366 of the discrete dilution holes 364 are parallel to a centerline 376 of the annular dilution slot 374. Further, the centerlines 366 of the discrete dilution holes 364 are in line with the aft face 379 of the annular dilution slot 374 at the axial location of the aft face 379 of the annular dilution slot 374.

Figure 8:
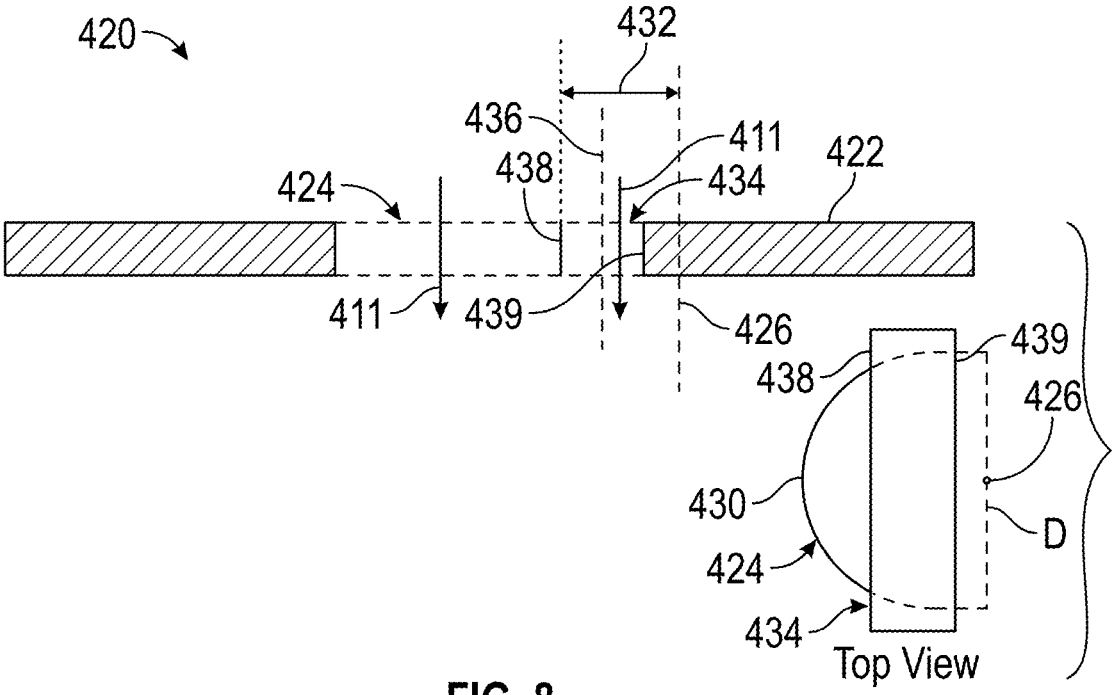
FIG. 8 shows a schematic side cross-sectional view of a dilution passage of a combustion liner, according to an embodiment of the present disclosure.

FIG. 8 shows a schematic side cross-sectional view of a dilution passage 411 of a combustion liner 422. The combustion liner 422 may be the same as or similar to the combustion liner of FIG. 2. Referring to FIG. 8, a side view 420 schematically represents the dilution passage 411, which may be similar to the dilution passage 211 of FIG. 2. The dilution passage 411 extends through the combustion liner 422 of a combustor. The dilution passage 411 has a geometry that is formed by concatenating a series of discrete dilution holes 424 and an annular dilution slot 434. Each discrete dilution hole 424 may be semicircular in cross section. For example, in a top view of the discrete dilution hole 424, a geometry 430 of the discrete dilution hole 424 may be semicircular. A centerline of the circle formed by two halves of the semi-circle may be a centerline 426 of each of the discrete dilution hole 424. That is, an axis extending through the center of the diameter of the discrete dilution hole 424 aligns with the centerline 426. The annular dilution slot 434 may have a forward face 438 and an aft face 439.

With continued reference to FIG. 8, the centerlines 426 of the discrete dilution holes 424 are parallel to a centerline 436 of the annular dilution slot 434. Further, the centerlines 426 of the discrete dilution holes 424 are aft of the aft face 439 of the annular dilution slot 434 at the axial location of the aft face 439 of the annular dilution slot 434. An offset 432, measured between the centerlines 426 of the discrete dilution holes 424 and the forward face 438 of the annular dilution slot 434, is between zero to 0.3 times the diameter D of the discrete dilution holes 424.

Figure 9:
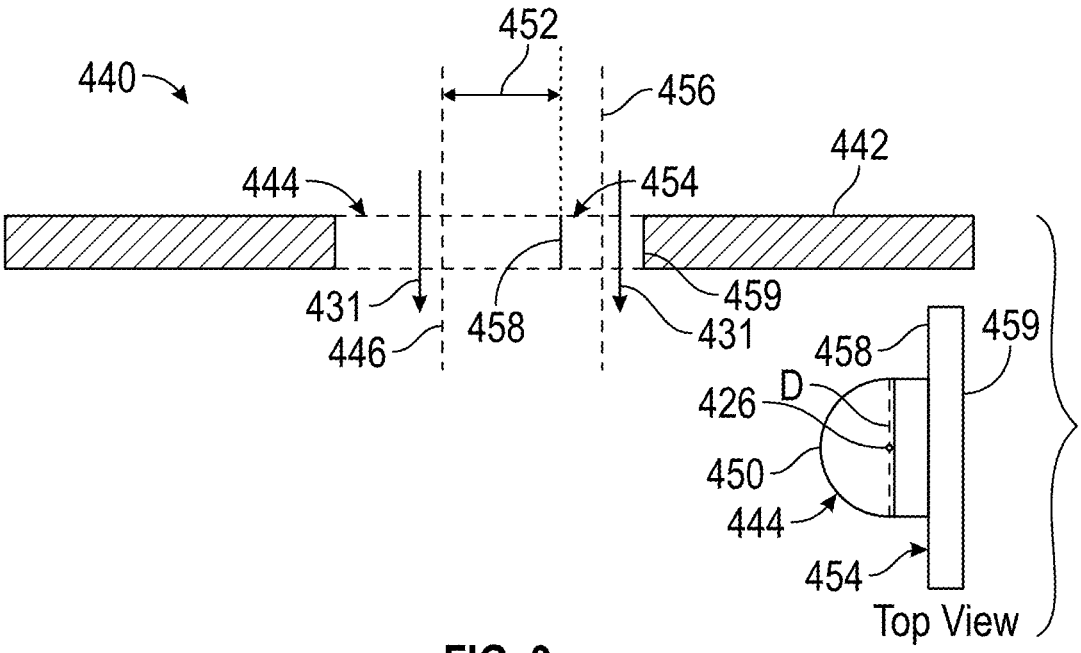
FIG. 9 shows a schematic side cross-sectional view of a dilution passage of a combustion liner, according to an embodiment of the present disclosure.

FIG. 9 shows a schematic side cross-sectional view of a dilution passage 431 of a combustion liner 442. The combustion liner 442 may be the same as or similar to the combustion liner of FIG. 2. Referring to FIG. 9, a side view 440 schematically represents the dilution passage 431, which may be similar to the dilution passage 211 of FIG. 2. The dilution passage 431 extends through the combustion liner 442 of a combustor. The dilution passage 431 has a geometry that is formed by concatenating a series of discrete dilution holes 444 and an annular dilution slot 454. Each discrete dilution hole 444 may be semicircular in cross section. For example, in a top view of the discrete dilution hole 444, a geometry 450 of the discrete dilution hole 444 may be semicircular. A centerline of the circle formed by two halves of the semi-circle may be a centerline 446 of each of the discrete dilution hole 424. That is, an axis extending through the center of the diameter of the discrete dilution hole 444 aligns with the centerline 446. The annular dilution slot 454 may have a forward face 458 and an aft face 459.

With continued reference to FIG. 9, the centerlines 446 of the discrete dilution holes 444 are parallel to a centerline 456 of the annular dilution slot 454. Further, the centerlines 446 of the discrete dilution holes 444 are forward of the forward face 458 of the annular dilution slot 434 at the axial location of the forward face 458 of the annular dilution slot 454. An offset 452, measured between the centerlines 446 of the discrete dilution holes 444 and the forward face 458 of the annular dilution slot 434 is between zero to one time the diameter D of the discrete dilution holes 444.

Figure 10:
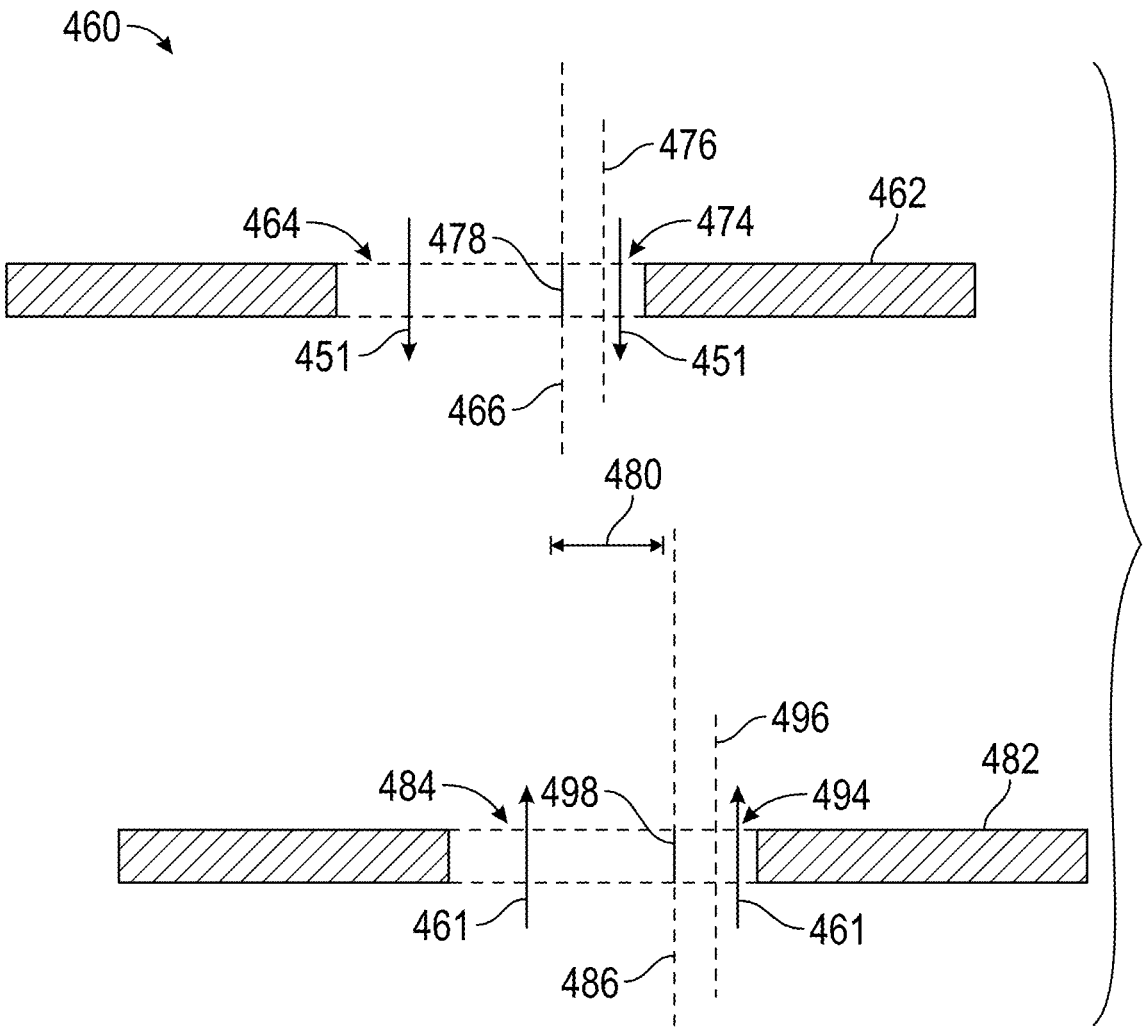
FIG. 10 shows a schematic side cross-sectional view of the dilution passages through an outer liner and an inner liner of a combustor, according to an embodiment of the present disclosure.

FIG. 10 shows a schematic side cross-sectional view 460 of a first dilution passage 451 through an outer liner 462 and a second dilution passage 461 through an inner liner 482 of a combustor, according to an embodiment of the present disclosure. The first dilution passage 451 has a geometry that is formed by concatenating a series of discrete dilution holes 464 and an annular dilution slot 474. Centerlines 466 of the discrete dilution holes 464 are parallel with a centerline 476 of the annular dilution slot 474 and in line with a forward face 478 of the annular dilution slot 474 at the axial location of the forward face 478 of the annular dilution slot 474. The second dilution passage 461 has a geometry that is formed by concatenating a series of discrete dilution holes 484 and an annular dilution slot 494. Centerlines 486 of the discrete dilution holes 484 are parallel with a centerline 496 of the annular dilution slot 494 and in line with a forward face 498 of the annular dilution slot 494 at the axial location of the forward face 498 of the annular dilution slot 494. An offset 480, measured between the centerlines 466 of the discrete dilution holes 464 on the outer liner 462 and the centerlines 486 of the discrete dilution holes 484 on the inner liner 482, is between zero to +/−six times a diameter of the discrete dilution holes 464 or 484.

Figure 11:
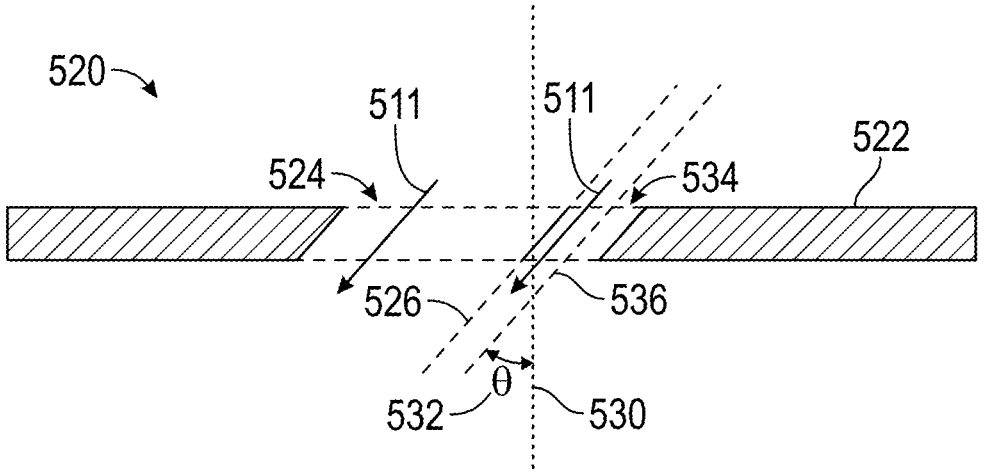
FIG. 11 shows a schematic side cross-sectional view of the dilution passage of the liner of FIG. 2, according to an embodiment of the present disclosure.

FIG. 11 shows a schematic side cross-sectional view 520 of a dilution passage 511 of a combustion liner 522. The dilution passage 511 has a geometry that is formed by concatenating a series of discrete dilution holes 524 and an annular dilution slot 534. Centerlines 526 of the discrete dilution holes 524 are parallel to a centerline 536 of the annular dilution slot 534. The centerlines 526 of the discrete dilution holes 524 and/or the centerline 536 of the annular dilution slot 534, that is, the flow direction of the discrete and annular flows, may be inclined at an angle theta 532, defined with respect to an axis 530 normal to the combustion liner 522. The angle theta may be from minus sixty degrees (inclined forward) to positive sixty degrees (inclined aft). Centerlines 526 of the discrete dilution holes 524 may be normal to the combustion liner 522 and centerline 536 of the annular dilution slot 534 inclined at the theta angle and vice versa. Although shown as being aligned with the centerline 536, the centerlines 526 may be offset in any of the previously described manners with respect to the description of FIGS. 7 to 10.

Figure 12:
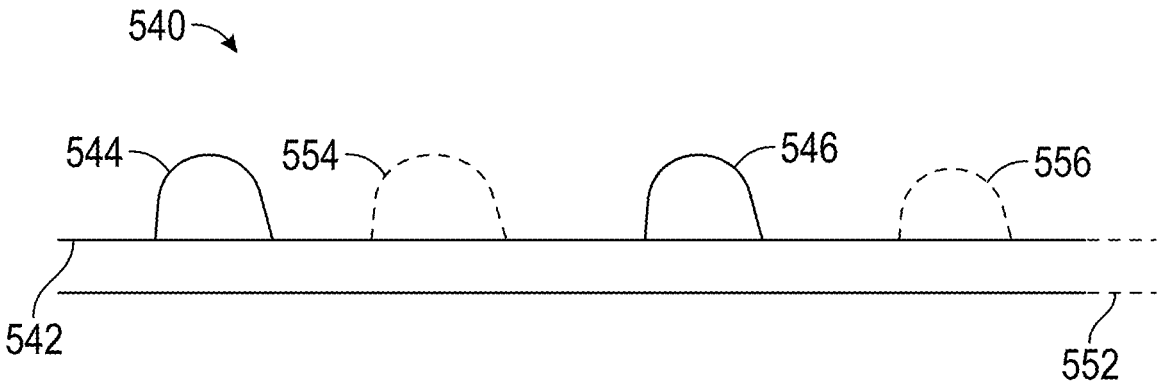
FIG. 12 shows a schematic top view of the dilution passages of an exemplary inner liner and outer liner of a combustor, according to an embodiment of the present disclosure.
Figure 13:
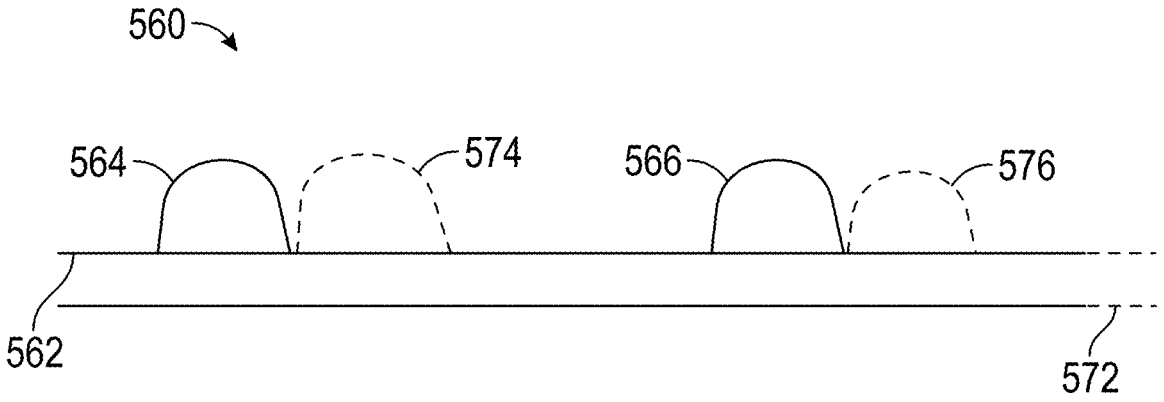
FIG. 13 shows schematic top view of the dilution passages of an exemplary inner liner and outer liner of a combustor, according to an embodiment of the present disclosure.

FIGS. 12 and 13 each shows a schematic top view of the dilution passages of exemplary inner liner and outer liner of a combustor, such as combustor 112 (FIG. 1), according to an embodiment of the present disclosure. A schematic outline of the dilution holes of an outer liner are shown overlain on the dilution holes of an inner liner. That is, when viewing the liner from a top view, the outline of the dilution holes of the inner liner and outer liner may appear as shown in either of FIG. 12 or 13.

For example, FIG. 12 shows a top view 540 of an outer liner 542 and an inner liner 552. The outer liner 542 has a series of outer liner discrete dilution holes including an outer liner discrete dilution hole 544 and an outer liner discrete dilution hole 546. Although two outer liner discrete dilution holes are shown, more may be provided. The inner liner 552 has a series of inner liner discrete dilution holes including an inner liner discrete dilution hole 554 and an inner liner discrete dilution hole 556. Although two inner liner discrete dilution holes are show, more may be provided.

The outer liner discrete dilution hole 544 and the outer liner discrete dilution hole 546 may directly oppose or may be angularly staggered with the inner liner discrete dilution hole 554 and the inner liner discrete dilution hole 556. In this manner, when the series of outer liner discrete dilution holes and inner liner discrete dilution holes are axially aligned, the inner liner discrete dilution hole 554 is circumferentially between the outer liner discrete dilution hole 544 and the outer liner discrete dilution hole 546. The inner liner discrete dilution hole 556 may be located between the outer liner discrete dilution hole 546 and a not shown, adjacent outer liner discrete dilution hole. Each of the inner liner discrete dilution holes may be halfway between adjacent outer liner discrete dilution holes.

Although shown and described as being staggered halfway, other offsets between the outer liner discrete dilution holes 544 and 546 and the inner liner discrete dilution holes 554 and 556 are contemplated. For example, FIG. 13, a top view 560 of an outer liner 562 and an inner liner 572. The outer liner 562 has a series of outer liner discrete dilution holes including an outer liner discrete dilution hole 564 and an outer liner discrete dilution hole 566. Although two outer liner discrete dilution holes are shown, more may be provided. The inner liner 572 has a series of inner liner discrete dilution holes including an inner liner discrete dilution hole 574 and an inner liner discrete dilution hole 576. Although two inner liner discrete dilution holes are show, more may be provided. The top liners of FIG. 13 may be the same as the liners of FIG. 12, however, the inner liner discrete dilution hole 574 and the inner liner discrete dilution hole 576 may be positioned circumferentially closer to the outer liner discrete dilution hole 564 and the outer liner discrete dilution hole 566, respectively, as compared to FIG. 13. That is, a distance between an inner liner discrete dilution hole, such as inner liner discrete dilution hole 574 and a first outer liner discrete dilution hole, such as the outer liner discrete dilution hole 564, may be smaller than a distance between the same inner liner discrete dilution hole (e.g., inner liner discrete dilution hole 574) and an outer liner discrete dilution hole adjacent to the first outer liner discrete dilution hole (e.g., outer liner discrete dilution hole 566). This relationship may be reversed and any distance between the dilution holes may be provided.

There may be other positional locations of the inner liner discrete dilution holes with respect to the outer liner discrete dilution holes in addition to, or as alternatives to, the two positions mentioned above. Further, outer liner discrete holes may be in line with a center of a swirler or at an angle with respect to the swirler. The angle may depend on the number of discrete holes per swirler cup liner.

Figure 14:
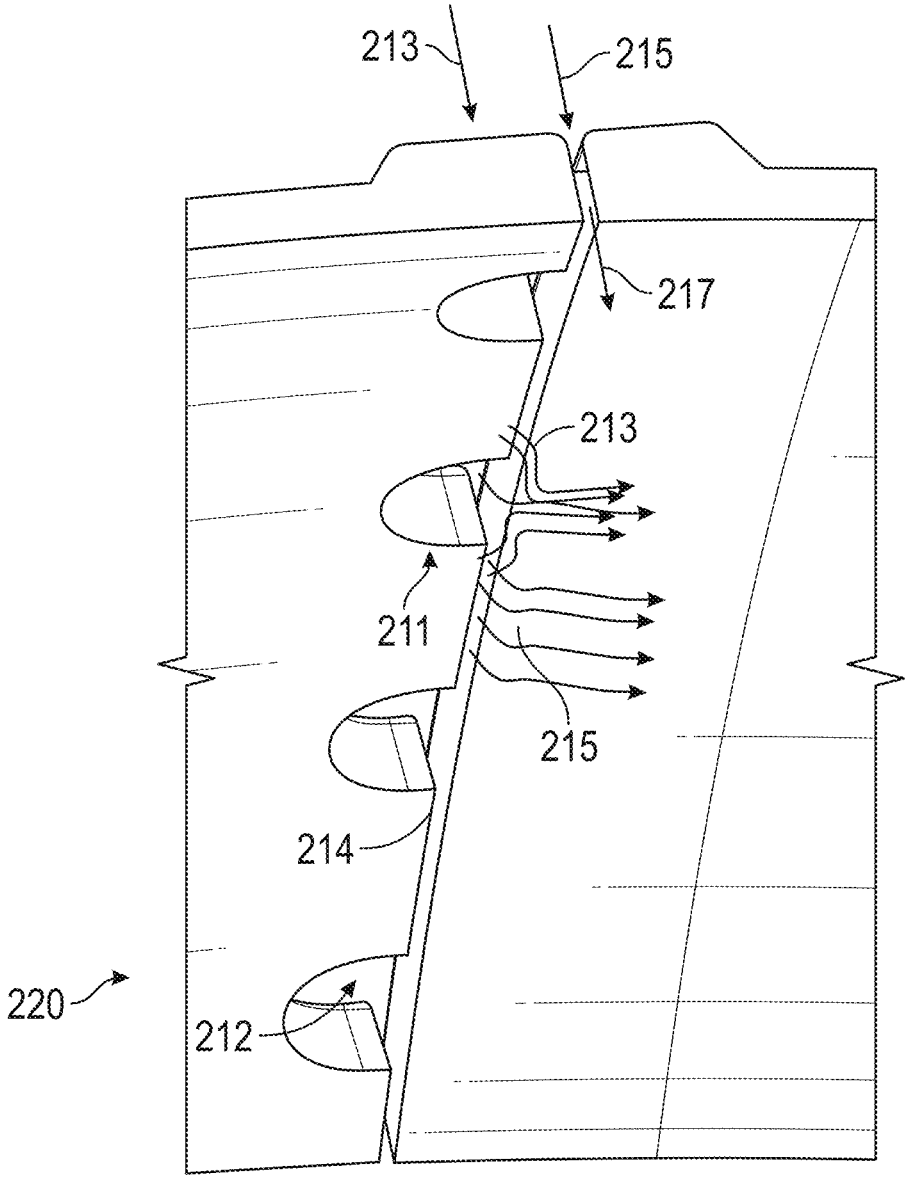
FIG. 14 shows a schematic, side perspective view of the flow dynamics through a liner for a combustor of FIG. 3, according to an embodiment of the present disclosure.

FIG. 14 shows a schematic, bottom perspective view of flow dynamics through a liner for a combustor of FIG. 3, according to an embodiment of the present disclosure. FIG. 14 is a schematic representation of the flow dynamics associated with the dilution passage 211 of FIG. 3. Referring to FIG. 14, reference numeral 220 indicates a bottom view that shows the dilution passage 211 of FIG. 2, that concatenates the discrete hole 212 with the annular slot 214. The first dilution air flow 213, passing through the discrete holes 212, is integrated with the second dilution air flow 215 passing through the annular slot 214 into the integrated dilution air flow 217, within the concatenated geometry of the dilution passage 211. Further, the integrated dilution air flow is injected into the core primary combustion zone 114 of the combustor 112 of FIG. 1 to attain a predetermined combustion state of the combustor 112.

The first dilution air flow 213 generates a turbulence in the core primary combustion zone 114 of the combustor 112 of FIG. 1. The first dilution air flow 213 through the discrete dilution holes may produce a region of wakes behind the first dilution air flow 213 exiting each of the discrete dilution holes. The second dilution air flow 215 fills the region of wakes formed behind a number of discrete jets of the first dilution air flow 213. Further, the second dilution air flow 215 provides a hydraulic support to the first dilution air flow 213 and enhances a penetration of the first dilution air flow 213 into the core primary combustion zone 114 of the combustor 112. Further, the second dilution air flow 215 percolates between the discrete jets of the first dilution air flow 213 and prevents development of any high temperature zone in proximity of the liner and in regions between the discrete jets of the first dilution air flow 213. Although described with respect to FIGS. 1 to 3, FIG. 15 may also describe flow in the dilution passages of FIGS. 4 to 14.

Figure 15:
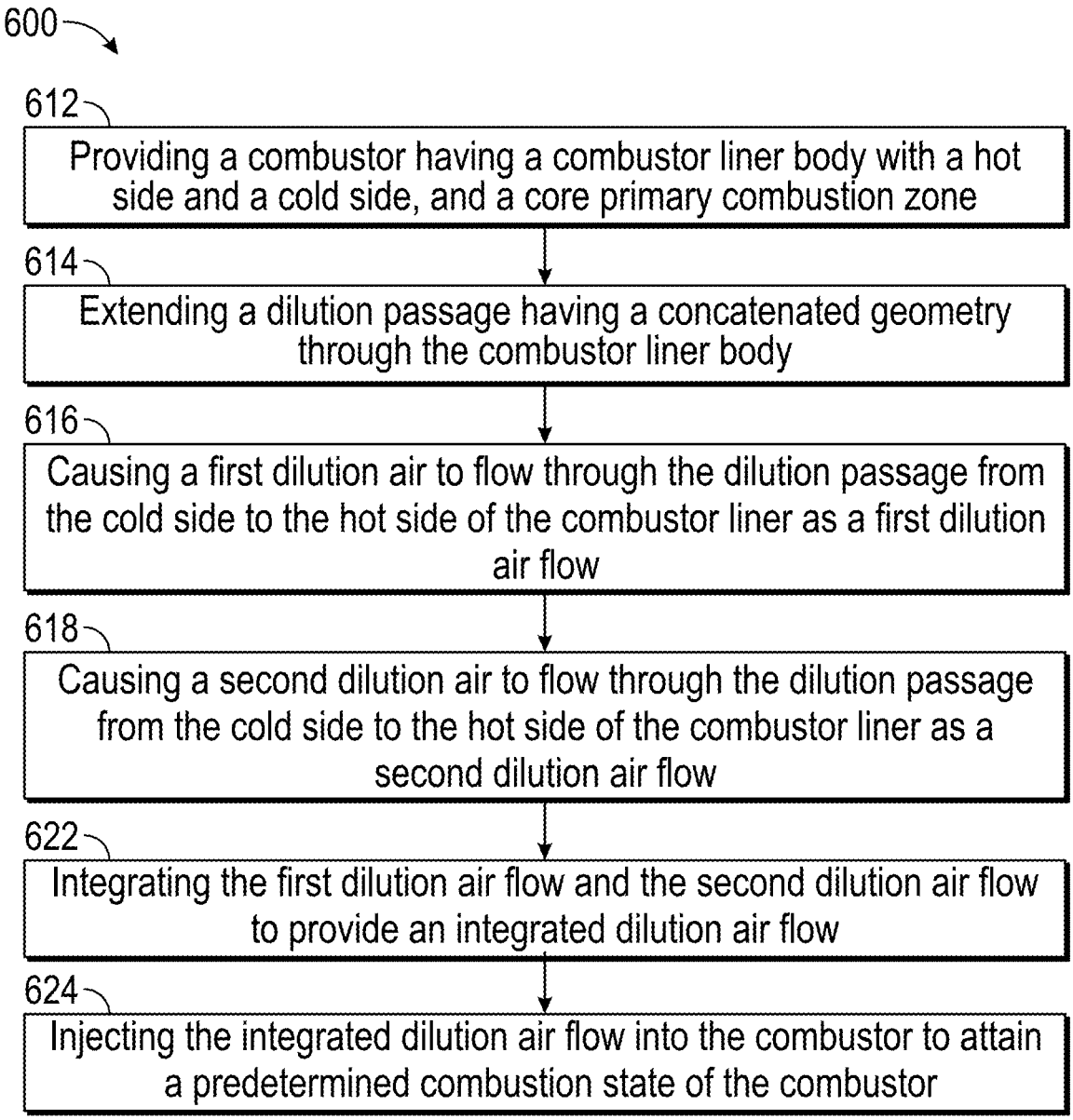
FIG. 15 shows a schematic flow diagram of a method of causing a dilution flow through a combustor liner of a combustor, according to an embodiment of the present disclosure.

FIG. 15 shows a schematic flow diagram of a method 600 of causing a dilution flow through a combustor liner, according to an embodiment of the present disclosure. The method 600 includes providing a combustor having (i) a combustor liner body with a hot side and a cold side, and (ii) a core primary combustion zone of the combustor, as shown in step 612. The method 600 also includes extending a dilution passage having a concatenated geometry through the combustor liner body, as shown in step 614. The method 600 further includes causing a first dilution air to flow through the dilution passage from the cold side to the hot side of the combustor liner, as shown in step 616. The method also includes causing a second dilution air to flow through the dilution passage from the cold side to the hot side of the combustor liner, as shown in step 618.

The concatenated geometry of the dilution passage is formed by concatenating a first geometry and a second geometry at a predetermined relative position such that the first dilution air and the second dilution air are integrated within the combined geometry of the dilution passage. The first geometry can be positioned forward or upstream with the second geometry positioned aft or downstream. The second geometry can be positioned forward or upstream with the first geometry positioned aft or downstream.

The first geometry includes at least one discrete hole and the second geometry includes at least one discrete annular slot. The size of the discrete features such as the holes and the annular slots, discretely positioned, can be varied circumferentially or can have a particular pattern along the circumference. The discrete holes can have a semi-circular cross section, or a triangular cross section with one side of the triangle aligned with and parallel to the annular slot, or a semi-elliptical cross section (e.g., race track) with a major axis in a lateral direction, or a semi-elliptical cross section (e.g., race track) with a major axis in an axial direction, or any combination thereof.

The concatenated geometry of the dilution passage can repeat in a predetermined pattern such as in a linear array substantially circumferential with respect to the combustor, or in a staggered array. The dilution passages can be oriented in a varying angle of predetermined orientation in relation to the combustor. The dilution passages can be arranged normal to an axis of the liner, or the dilution passages can be inclined at an angle to the axis of the swirler.

The method 600 further includes integrating the first dilution air flow and the second dilution air flow to provide an integrated dilution air flow to increase mixing with a number of combustion products in a primary combustion zone of the combustor, as shown in step 622. The method 600 also includes injecting the integrated dilution air flow into the combustor to attain a predetermined combustion state of the combustor, as shown in step 624.

The predetermined combustion state of the combustor includes a compliant $NO_x$ emission level. The predetermined combustion state of the combustor further includes reducing a temperature in a core primary combustion zone of the combustor. The predetermined combustion state of the combustor further includes a reduced temperature in a core primary combustion zone of the combustor. The predetermined combustion state of the combustor further includes reducing a temperature in a wake region of the dilution jet or dilution insert. The predetermined combustion state of the combustor further includes reducing a temperature between dilution jets or dilution insert. The predetermined combustion state of the combustor also includes a uniform temperature distribution within a primary combustion zone and a secondary combustion zone of the combustor. The predetermined combustion state of the combustor includes a combustor exit temperature profile conforming with a reference temperature profile. The predetermined combustion state of the combustor also includes rapid quenching and a quick and an increased mixing of the first dilution air flow and the second dilution air flow with a number of combustion products in a primary combustion zone of the combustor. Further, the predetermined combustion state of the combustor includes a balance of a predetermined air split ratio (relative distribution or share) of the first dilution air flow and the second dilution air flow.

The liner for a gas turbine engine combustor of the present disclosure provides a dilution passage with a concatenated geometry that integrates a first dilution air flow and a second dilution air flow into an integrated dilution air flow.

When the second dilution air flow is downstream of the first dilution air flow, the second dilution air flow may provide a hydraulic support to the first dilution air flow. When the second dilution air flow is upstream of the first dilution air flow, the second dilution air flow may provide a hydraulic shield for the first dilution air flow. In both cases, the hydraulic support and/or hydraulic shielding may percolate between the discrete jets of the first dilution air flow and enhance a penetration of the first dilution air flow into a core primary combustion zone of the combustor.

The integrated dilution air flow increases rapid quenching and mixing of the dilution air flows with a number of combustion products in a primary combustion zone of the combustor leading to a uniform temperature distribution within the primary combustion zone of the combustor and a combustor exit temperature profile conforming with a reference temperature profile. The integrated dilution air flow reduces an emission level of nitrogen oxides ($NO_x$) in a core primary combustion zone of the combustor in compliance with regulatory guidelines.

Further aspects of the present disclosure are provided by the subject matter of the following clauses.

A liner for a combustor in a gas turbine engine has a liner body having a cold side and a hot side, and a dilution passage having a concatenated geometry extending through the liner body, the dilution passage configured (i) to integrate a first dilution air flow flowing through the dilution passage from the cold side to the hot side and a second dilution air flow flowing through the dilution passage from the cold side to the hot side into an integrated dilution air flow, and (ii) to inject the integrated dilution air flow into a core primary combustion zone of the combustor to attain a predetermined combustion state of the combustor.

The liner of the preceding clause, wherein the second dilution air flow provides a hydraulic support to the first dilution air flow and enhances a penetration of the first dilution air flow into the core primary combustion zone of the combustor.

The liner of any preceding clause, wherein the first dilution air flow generates a turbulence in the core primary combustion zone of the combustor and the second dilution air flow fills a region of wakes formed behind a plurality of discrete jets of the first dilution air flow.

The liner of any preceding clause, wherein the second dilution air flow percolates between a plurality of discrete jets of the first dilution air flow and prevents a development of a high temperature zone in a proximity of the liner and between the plurality of discrete jets.

The liner of any preceding clause, wherein the predetermined combustion state of the combustor comprises (i) a reduced temperature in the core primary combustion zone of the combustor, (ii) a compliant $NO_x$ emission level, (iii) a uniform temperature distribution within the core primary combustion zone of the combustor, (iv) a combustor exit temperature profile conforming with a reference temperature profile, (v) an increased mixing of the first dilution air flow and the second dilution air flow with a plurality of combustion products in the core primary combustion zone of the combustor, (vi) a rapid quenching and a quick mixing of the first dilution air flow and the second dilution air flow with a plurality of combustion products in the core primary combustion zone of the combustor, (vii) a predetermined air split ratio of the first dilution air flow and the second dilution air flow, or (viii) any combination thereof.

The liner of any preceding clause, wherein the first dilution air flow is ten percent to ninety percent of a total flow through the dilution passage.

The liner of any preceding clause, wherein the concatenated geometry comprises at least a first geometry and a second geometry concatenated at a predetermined relative position and wherein the first dilution air flow flows through the first geometry and the second dilution air flow flows through the second geometry.

The liner of any preceding clause, wherein the second geometry comprises an annular slot and the first geometry comprises a discrete hole having a semicircular cross section, an elliptical cross section, a race track cross section, or a triangular cross section with one side of the triangular cross section aligned and parallel with the annular slot.

The liner of any preceding clause, wherein the first geometry comprises a plurality of discrete holes and the second geometry comprises an annular slot.

The liner of any preceding clause, wherein the annular dilution slot is downstream of the plurality of discrete dilution holes.

The liner of any preceding clause, wherein the dilution passage comprises a plurality of discrete dilution holes through which flows the first dilution air flow and an annular dilution slot through which flows the second dilution air flow.

The liner of any preceding clause, wherein each of the plurality of discrete dilution holes has a first centerline and the annular dilution slot has a second centerline, and wherein the first centerline is parallel with the second centerline.

The liner of any preceding clause, wherein the first centerline is offset forward of the second centerline and aligned with a forward surface of the annular dilution slot.

The liner of any preceding clause, wherein the first centerline is offset forward of the second centerline and forward of a forward surface of the annular dilution slot.

The liner of any preceding clause, wherein the first centerline is offset aft of the second centerline and aligned with an aft surface of the annular dilution slot.

The liner of any preceding clause, wherein the first centerline is offset aft of the second centerline and aft of an aft surface of the annular dilution slot.

The liner of any preceding clause, wherein the first centerline and the second centerline are angled with respect to an axis normal to the liner.

The liner of any preceding clause, wherein the liner body comprises an outer liner and an inner liner, each of the outer liner and the inner liner comprising the dilution passage such that the outer liner comprises an outer liner first dilution air flow and an outer liner second dilution air flow and the inner liner comprises an inner liner first dilution air flow and an inner liner second dilution air flow.

The liner of any preceding clause, wherein, in a top view, the outer liner first dilution air flow is offset from the inner liner first dilution air flow.

A method of diluting a flow through a combustor including causing a first dilution air flow from a cold side of a combustion liner to a hot side of the combustion liner, causing a second dilution air flow from the cold side of the combustion liner to the hot side of the combustion liner, integrating the first dilution air flow and the second dilution air flow to provide an integrated dilution air flow, injecting the integrated dilution air flow into the combustor to attain a predetermined combustion state of the combustor, generating a turbulence in a core primary combustion zone of the combustor with the first dilution air flow, and filling a region of wakes formed behind the first dilution air flow with the second dilution air flow, wherein the integrated dilution air flow is formed by a concatenated geometry through the combustion liner.

Although the foregoing description is directed to the preferred embodiments, it is noted that other variations and modifications will be apparent to those skilled in the art, and may be made without departing from the spirit or scope of the disclosure Moreover, features described in connection with one embodiment may be used in conjunction with other embodiments, even if not explicitly stated above.

The invention claimed is:

1. A method of diluting a flow through a combustor the combustor having a central engine axis defining a circumferential direction, the method comprising:

causing a first dilution air flow from a cold side of a combustion liner to a hot side of the combustion liner through a plurality of discrete dilution holes extending through the combustion liner;

causing a second dilution air flow from the cold side of the combustion liner to the hot side of the combustion liner through an annular dilution slot extending through the combustion liner, the annular dilution slot having a forward face and an aft face;

integrating the first dilution air flow and the second dilution air flow to provide an integrated dilution air flow, the integrated dilution air flow being formed by a concatenated geometry extending through the combustion liner, the concatenated geometry including the annular dilution slot and the plurality of discrete dilution holes positioned at least partially forward of the annular dilution slot such that the aft face of the annular dilution slot extends only in the circumferential direction;

injecting the integrated dilution air flow into the combustor to attain a predetermined combustion state of the combustor; generating a turbulence in a core primary combustion zone of the combustor with the first dilution air flow; and filling a region of wakes formed behind the first dilution air flow with the second dilution air flow.

2. The method of claim 1, further comprising percolating the second dilution air flow between a plurality of discrete jets of the first dilution air flow to prevent a development of a high temperature zone in a proximity of the combustion liner between the plurality of discrete jets.

3. The method of claim 1, wherein the first dilution air flow is ten percent to ninety percent of a total flow from the cold side of the combustion liner to the hot side of the combustion liner.

4. The method of claim 1, wherein the plurality of discrete dilution holes includes a semicircular cross section, an elliptical cross section, a race track cross section, or a triangular cross section with one side of the triangular cross section aligned and parallel with the annular dilution slot.

5. The method of claim 1, further comprising flowing the first dilution air flow through the plurality of discrete dilution holes and flowing the second dilution air flow through the annular dilution slot such that the second dilution air flow through the annular dilution slot is downstream of the first dilution air flow through the plurality of discrete dilution holes.

6. The method of claim 1, further comprising flowing the first dilution air flow through a first centerline of the plurality of discrete dilution holes and flowing the second dilution air flow through a second centerline of the annular dilution slot such that the first dilution air flow through the first centerline is parallel with the second dilution air flow through the second centerline.

7. The method of claim 6, further comprising flowing the first dilution air flow through the first centerline of each of the plurality of discrete dilution holes and flowing the second dilution air flow through the second centerline of the annular dilution slot such that the first dilution air flow through the first centerline is offset from the second dilution air flow through the second centerline and forward of the forward face of the annular dilution slot.

8. The method of claim 6, further comprising flowing the first dilution air flow through the first centerline of each of the plurality of discrete dilution holes and flowing the second dilution air flow through the second centerline of the annular dilution slot such that the first dilution air flow through the first centerline is offset aft of the second dilution air flow through the second centerline and aligned with the aft face of the annular dilution slot.

9. The method of claim 1, wherein the concatenated geometry includes the plurality of discrete dilution holes positioned forward of the annular dilution slot such that an aft face of the plurality of discrete dilution holes concatenates with the forward face of the annular dilution slot.

10. The method of claim 1, further comprising providing hydraulic support to the first dilution air flow with the second dilution air flow.

11. The method of claim 1, further comprising enhancing a penetration of the first dilution air flow into the core primary combustion zone of the combustor with the second dilution air flow.

12. A method of diluting a flow through a combustor the combustor having a central engine axis defining a circumferential direction, the method comprising:

causing a first dilution air flow from a cold side of a combustion liner to a hot side of the combustion liner by flowing the first dilution air flow through a plurality of discrete dilution holes extending through the combustion liner;

causing a second dilution air flow from the cold side of the combustion liner to the hot side of the combustion liner by flowing the second dilution air flow through an annular dilution slot extending through the combustion liner, the annular dilution slot having a forward face and an aft face, plurality of discrete dilution holes and the annular dilution slot forming a concatenated geometry, the concatenated geometry including the annular dilution slot and the plurality of discrete dilution holes positioned at least partially forward of the annular dilution slot such that the aft face of the annular dilution slot extends only in the circumferential direction, and wherein the first dilution air flow is ten percent to ninety percent of a total flow from the cold side of the combustion liner to the hot side of the combustion liner;

integrating the first dilution air flow and the second dilution air flow to provide an integrated dilution air flow; injecting the integrated dilution air flow into the combustor to attain a predetermined combustion state of the combustor;

generating a turbulence in a core primary combustion zone of the combustor with the first dilution air flow; and filling a region of wakes formed behind the first dilution air flow with the second dilution air flow.

13. The method of claim 12, further comprising percolating the second dilution air flow between a plurality of discrete jets of the first dilution air flow to prevent a development of a high temperature zone in a proximity of the combustion liner between the plurality of discrete jets.

14. The method of claim 12, wherein the plurality of discrete dilution holes includes a semicircular cross section, an elliptical cross section, a race track cross section, or a triangular cross section with one side of the triangular cross section aligned and parallel with the annular dilution slot.

15. The method of claim 12, further comprising flowing the first dilution air flow through the plurality of discrete dilution holes and flowing the second dilution air flow through the annular dilution slot such that the second dilution air flow through the annular dilution slot is downstream of the first dilution air flow through the plurality of discrete dilution holes.

16. The method of claim 12, further comprising flowing the first dilution air flow through a first centerline of the plurality of discrete dilution holes and flowing the second dilution air flow through a second centerline of the annular dilution slot such that the first dilution air flow through the first centerline is parallel with the second dilution air flow through the second centerline.

17. The method of claim 16, further comprising flowing the first dilution air flow through the first centerline of each of the plurality of discrete dilution holes and flowing the second dilution air flow through the second centerline of the annular dilution slot such that the first dilution air flow through the first centerline is offset from the second dilution air flow through the second centerline and forward of the forward face of the annular dilution slot.

18. The method of claim 16, further comprising flowing the first dilution air flow through the first centerline of each of the plurality of discrete dilution holes and flowing the second dilution air flow through the second centerline of the annular dilution slot such that the first dilution air flow through the first centerline is offset aft of the second dilution air flow through the second centerline and aligned with the aft face of the annular dilution slot.

19. The method of claim 12, wherein the concatenated geometry includes the plurality of discrete dilution holes positioned forward of the annular dilution slot such that an aft face of the plurality of discrete dilution holes concatenates with the forward face of the annular dilution slot.

20. The method of claim 12, further comprising providing hydraulic support to the first dilution air flow with the second dilution air flow.

* * * * *